US007817932B2

(12) United States Patent
Hamanaka

(10) Patent No.: US 7,817,932 B2
(45) Date of Patent: Oct. 19, 2010

(54) IMAGE FORMING APPARATUS AND CONTROL METHOD OF THE SAME

(75) Inventor: Takahiro Hamanaka, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 142 days.

(21) Appl. No.: 12/207,212

(22) Filed: Sep. 9, 2008

(65) Prior Publication Data

US 2009/0067870 A1 Mar. 12, 2009

Related U.S. Application Data

(60) Provisional application No. 60/971,541, filed on Sep. 11, 2007.

(51) Int. Cl.
*G03G 15/00* (2006.01)
*G03G 15/04* (2006.01)

(52) U.S. Cl. ..... 399/49; 399/15; 399/51

(58) Field of Classification Search ..... 399/49, 399/51, 15, 72; 358/406, 504
See application file for complete search history.

(56) References Cited

U.S. PATENT DOCUMENTS

| | | | | |
|---|---|---|---|---|
| 6,934,481 | B2 * | 8/2005 | Hama | 399/49 |
| 2008/0159763 | A1 * | 7/2008 | Nakane | 399/49 |
| 2008/0193148 | A1 * | 8/2008 | Bonino | 399/15 |
| 2009/0087199 | A1 * | 4/2009 | Moro | 399/15 |

FOREIGN PATENT DOCUMENTS

| | | |
|---|---|---|
| JP | 2001-66835 | 3/2001 |

* cited by examiner

*Primary Examiner*—Sophia S Chen
(74) *Attorney, Agent, or Firm*—Patterson & Sheridan, LLP

(57) ABSTRACT

A test pattern image stored in advance is printed on a paper sheet. When the printed test pattern image is scanned by a scanning unit, a difference between the density of the scanned test pattern image and absolute density set in advance is detected. An exposure amount of a process unit is adjusted according to the detected density difference.

19 Claims, 7 Drawing Sheets

IMAGE FORMING APPARATUS AND CONTROL METHOD OF THE SAME

CROSS-REFERENCE TO RELATED APPLICATION

This application is based upon and claims the benefit of priority from U.S. Provisional Application No. 60/971,541 filed on Sep. 11, 2007, the entire contents of which are incorporated herein by reference.

TECHNICAL FIELD

The present invention relates to an image forming apparatus and a control method of the same having a density adjusting function for adjusting print density.

BACKGROUND

An image forming apparatus that can perform color copying includes plural photoconductive drums corresponding to yellow (Y), magenta (M), cyan (C), and black (K), respectively, and also includes an exposing unit, a developing unit, a transfer belt, plural primary transfer rollers, plural secondary transfer rollers, and a heat roller.

The exposing unit exposes the surfaces of the photoconductive drums with laser beams to thereby form electrostatic latent images on the surfaces of the photoconductive drums, respectively. The developing units develop the electrostatic latent images formed on the surfaces of the photoconductive drums with yellow, magenta, cyan, and black developers to visualize the electrostatic latent images, respectively. The transfer belt rotates while coming into contact with the surfaces of the respective photoconductive drums. The primary transfer rollers press the rotating transfer belt against the surfaces of the photoconductive drums and transfer visible images on the photoconductive drums onto the transfer belt. The secondary transfer rollers transfer the visible images of the respective colors, which are transferred onto the transfer belt, onto a paper sheet. The heat roller applies heat to the paper sheet having the visible images transferred thereon to fix the visible images on the paper sheet. Printing of an image is completed by the fixing of the visible images.

After transferring the visible images of the respective colors onto the paper sheet, the transfer belt continues the rotation until developers remaining thereon are removed by a cleaner. However, when the transfer belt continues the rotation while coming into contact with the photoconductive drums, the surfaces of the photoconductive drums are worn and the durable life of the photoconductive drums is reduced.

Therefore, after the visible images on the transfer belt are transferred onto the paper sheet, the transfer rollers move to the opposite side of the transfer belt. The transfer belt is separated from the photoconductive drums by the movement of the transfer rollers. After the developers remaining on the transfer belt are removed by the cleaner, the transfer rollers move to the transfer belt side. The transfer belt is brought into contact with the photoconductive drums again by the movement of the transfer rollers.

In such an image forming apparatus, the density of an image printed on the paper sheet may deviate from intrinsic appropriate density, i.e., so-called absolute density due to contact failure of the transfer belt with respective photoconductive drums.

In order to prevent such deviation of the density, in an image forming apparatus disclosed in JP-A-2001-66835, patches are provided at both ends in main scanning for optically scanning an image of an original, the patches are scanned by the main scanning, a difference between densities of images obtained by the scanning is calculated, reference density is calculated from the calculated density difference, and an exposure amount on photoconductive drums is corrected on the basis of the calculated reference density.

SUMMARY

In the image forming apparatus in which the exposure amount is corrected by using the two patches as described above, when variation with time occurs in the densities of the patches, eventually, the density of the image printed on the paper sheet cannot be maintained at the intrinsic appropriate density, i.e., so-called absolute density.

It is an object of an aspect of the present invention to provide an image forming apparatus and a control method of the same that can surely maintain the density of an image printed on a paper sheet at intrinsic appropriate density, i.e., so-called absolute density.

An image forming apparatus according to an aspect of the present invention includes: a scanning unit which optically scans an image of an original; a process unit which has image bearing members and exposes the image bearing members according to the image scanned by the scanning unit to thereby print the scanned image on a paper sheet; a storing unit having stored therein a test pattern image; a control section which controls the process unit to print the test pattern image stored in the storing unit on the paper sheet; a detecting section which detects, when the printed test pattern image is scanned by the scanning unit, a difference between the density of the scanned test pattern image and absolute density set in advance; and an adjusting section which adjusts an exposure amount of the process unit according to the density difference detected by the detecting section.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

An embodiment of the present invention is explained below with reference to the accompanying drawings.

Figure 1:
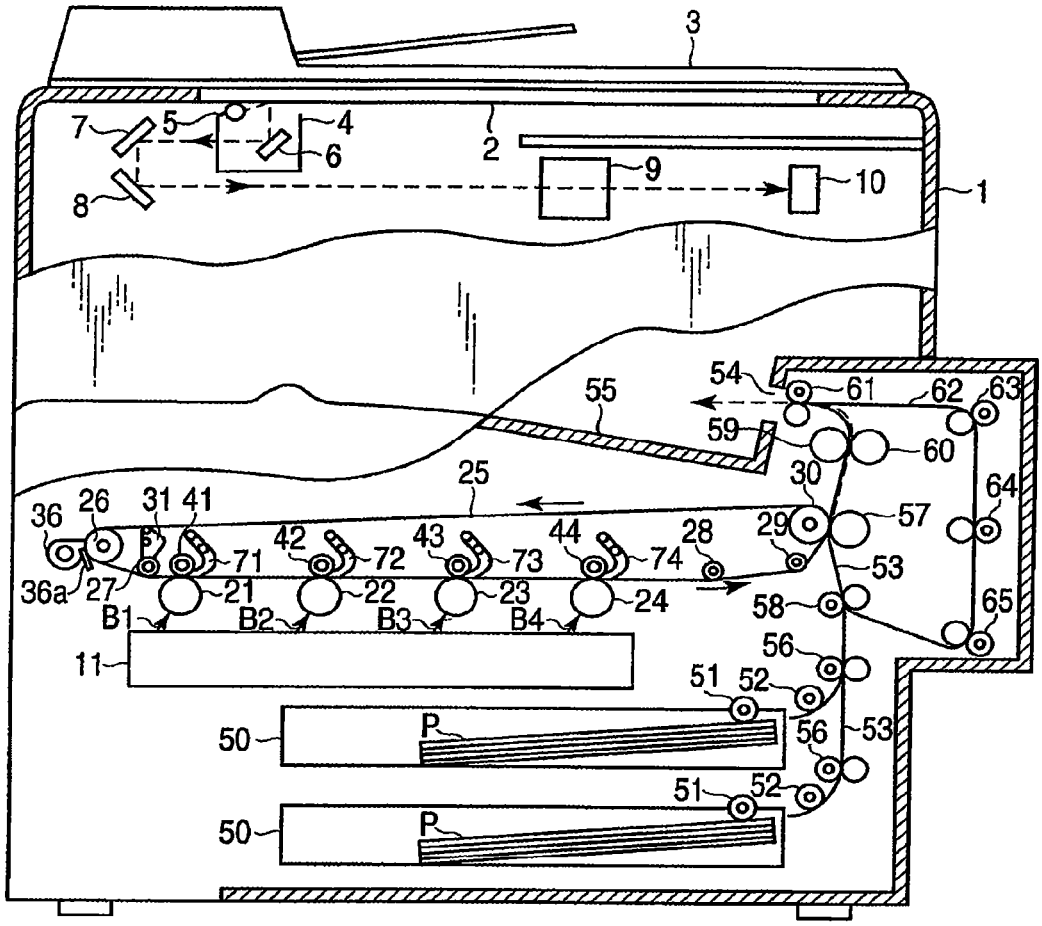
FIG. 1 is a diagram showing a general configuration of an embodiment of the present invention.

As shown in FIG. 1, a transparent original glass (a glass plate) 2 for placing an original is provided in an upper part of a main body 1. A cover 3 is openably and closably provided on the original glass 2. A carriage 4 is provided on a lower surface side of the original glass 2. An exposure lamp 5 is provided in the carriage 4. The carriage 4 can reciprocatingly move along the lower surface of the original glass 2. The exposure lamp 5 is turned on while the carriage 4 is moving forward, whereby an original on the original glass 2 is exposed to light. A reflected light image of the original on the original glass 2 is obtained by the exposure. The reflected light image is projected on a CCD (Charge Coupled Device) 10 by reflection mirrors 6, 7, and 8 and a magnification lens block 9. The CCD 10 outputs an image signal of a level corresponding to the reflected light image of the original.

A scanning unit that optically scans an image of the original placed on the original glass 2 is configured by the carriage 4, the exposure lamp 5, the reflection mirrors 6, 7, and 8, the magnification lens block 9, and the CCD 10.

Image signals outputted from the CCD 10 are supplied to an exposing unit 11 after being appropriately processed. The exposing unit 11 emits a laser beam B1 corresponding to a yellow image signal, a laser beam B2 corresponding to a magenta image signal, a laser beam B3 corresponding to a cyan image signal, and a laser beam B4 corresponding to a black image signal to a photoconductive drum 21 for yellow, a photoconductive drum 22 for magenta, a photoconductive drum 23 for cyan, and a photoconductive drum 24 for black, respectively.

The photoconductive drums 21, 22, 23, and 24 are arrayed in a substantially horizontal direction at fixed intervals. A transfer belt 25 is provided above the photoconductive drums 21, 22, 23, and 24. The transfer belt 25 is laid over a drive roller 26, guide rollers 27, 28, and 29, and a driven roller 30. The transfer belt 25 receives power from the drive roller 26 and rotates in the counterclockwise direction. The guide roller 27 is provided to freely move up and down. The guide roller 27 receives the rotational motion of a cam (a third cam) 31 and moves to the photoconductive drum 21 side to thereby displace the transfer belt 25 to the photoconductive drums 21, 22, 23, and 24 side.

Primary transfer rollers 41, 42, 43, and 44 are provided to freely move up and down in positions opposed to the photoconductive drums 21, 22, 23, and 24, respectively. The primary transfer rollers 41, 42, 43, and 44 are displaced (lowered) to the transfer belt 25 side to thereby rotate while pressing the transfer belt 25 against and bringing the same into contact with the photoconductive drums 21, 22, 23, and 24 and transfer visible images on the photoconductive drums 21, 22, 23, and 24 onto the transfer belt 25.

Figure 2:
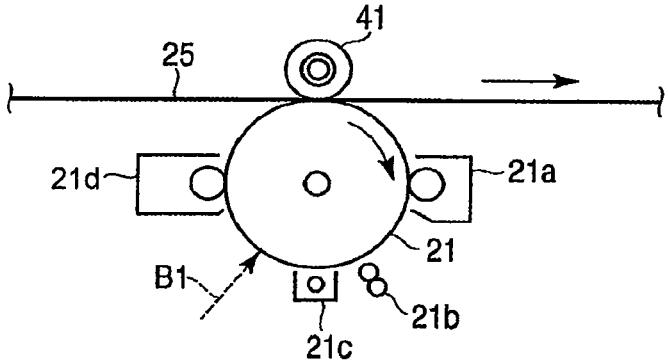
FIG. 2 is a diagram showing a main part of FIG. 1.

The photoconductive drum 21 and a configuration of the periphery thereof are shown in FIG. 2. A cleaner 21*a*, a charge removing lamp 21*b*, a charging unit 21*c*, and a developing unit 21*d* are sequentially disposed around the photoconductive drum 21. The cleaner 21*a* removes a developer remaining on the surface of the photoconductive drum 21. The charge removing lamp 21*b* removes electric charge remaining on the surface of the photoconductive drum 21. The charging unit 21*c* applies high voltage to the photoconductive drum 21 to thereby charge the surface of the photoconductive drum 21 with static electric charge. The laser beam B1 emitted from the exposing unit 11 is irradiated on the surface of the photoconductive drum 21 subjected to the charging. An electrostatic latent image is formed on the surface of the photoconductive drum 21 by the irradiation of the laser beam B1. The developing unit 21*d* supplies a yellow developer (toner) to the surface of the photoconductive drum 21 to thereby develop the electrostatic latent image on the surface of the photoconductive drum 21 in yellow and visualize the same.

The other photoconductive drums 22, 23, and 24 and configurations of peripheries thereof are the same as the above. Therefore, explanation of the photoconductive drums 22, 23, and 24 and the configurations is omitted.

Plural paper feeding cassettes 50 are provided below the exposing unit 11. The paper feeding cassettes 50 store a large number of paper sheets P of sizes different from one another. Pickup rollers 51 and separation rollers 52 are provided in positions opposed to the paper feeding cassettes 50, respectively. Each of the pickup rollers 51 extracts paper sheets P in each of the paper feeding cassettes 50 one by one. Each of the separation rollers 52 separates the paper sheet P extracted by the pickup roller 51 from each of the paper feeding cassettes 50 and feeds the paper sheet P to a conveying path 53.

The conveying path 53 extends to a paper discharge port 54 in an upper part through the driven roller 30. The paper discharge port 54 faces a paper discharge tray 55 that continues to an outer peripheral surface of the main body 1.

Paper feeding rollers 56 are provided near the separation rollers 52, respectively. A secondary transfer roller 57 is provided in a position opposed to the driven roller 30 in the conveying path 53 across the transfer belt 25. Registration rollers 58 are provided in a position before the driven roller 30 and the secondary transfer roller 57. The registration rollers 58 feed the paper sheet P into between the transfer belt 25 and the secondary transfer roller 57. The secondary transfer roller 57 transfers visible images transferred on the transfer belt 25 onto the paper sheet P fed by the registration rollers 58.

In the conveying path 53, a heat roller 59 for heat fixing and a press-contact roller 60 set in contact with the heat roller 59 are provided in a position further on a downstream side than the secondary transfer roller 57. Paper discharge rollers 61 are provided at a terminal end of the conveying path 53.

A conveying path 62 for reversing the front and the back of the paper sheet P is provided from the terminal end of the conveying path 53 to a position on an upstream side of the registration roller 58. Paper feeding rollers 63, 64, and 65 are provided in the conveying path 62. The paper sheet P that reaches the terminal end of the conveying path 53 is returned to the conveying path 53 through the conveying path 62, whereby the visible images on the transfer belt 25 are transferred onto a rear surface of the paper sheet P as well.

On the other hand, a cleaner 36 is provided in a position opposed to the drive roller 26 across the transfer belt 25. The cleaner 36 has a cleaning blade 36*a* set in contact with the transfer belt 25 and removes a developer remaining on the transfer belt 25.

Hooks 71, 72, 73, and 74 are provided near the primary transfer rollers 41, 42, 43, and 44. The hooks 71, 72, 73, and 74 lift shafts of the primary transfer rollers 41, 42, 43, and 44 and displace the primary transfer rollers 41, 42, 43, and 44 upward. The transfer belt 25 is separated from the surfaces of the photoconductive drums 21, 22, 23, and 24 by the displacement. The hooks 71, 72, 73, and 74 pivot during operation and lift the shafts of the primary transfer rollers 41, 42, 43, and 44. The hooks 71, 72, 73, and 74 return during non-operation and release the lifting of the primary transfer rollers 41, 42, 43, and 44. When the shafts of the primary transfer rollers 41, 42, 43, and 44 are lifted, the primary transfer rollers 41, 42, 43, and 44 are displaced upward and the transfer belt 25 is separated from the surfaces of the photoconductive drums 21, 22, 23, and 24. When the lifting of the primary transfer rollers 41, 42, 43, and 44 is released, the primary transfer rollers 41, 42, 43, and 44 are displaced downward and the transfer belt 25 is pressed against and brought into contact with the surfaces of the photoconductive drums 21, 22, 23, and 24.

After transferring the visible images of the respective colors onto the paper sheet P, the transfer belt 25 continues the rotation until developers remaining thereon are removed by the cleaner 36. However, when the transfer belt 25 continues the rotation while coming into contact with the photoconductive drums 21, 22, 23, and 24, the surfaces of the photoconductive drums 21, 22, 23, and 24 are worn and the durable life of the photoconductive drums 21, 22, 23, and 24 is reduced. Therefore, after the visible images on the transfer belt 25 are transferred onto the paper sheet P, the primary transfer rollers 41, 42, 43, and 44 are displaced upward to separate the transfer belt 25 from the surfaces of the photoconductive drums 21, 22, 23, and 24. After the developers remaining on the transfer belt 25 are removed by the cleaner 36, the primary transfer rollers 41, 42, 43, and 44 are displaced downward to bring the transfer belt 25 into contact with the photoconductive drums 21, 22, 23, and 24.

Figure 3:
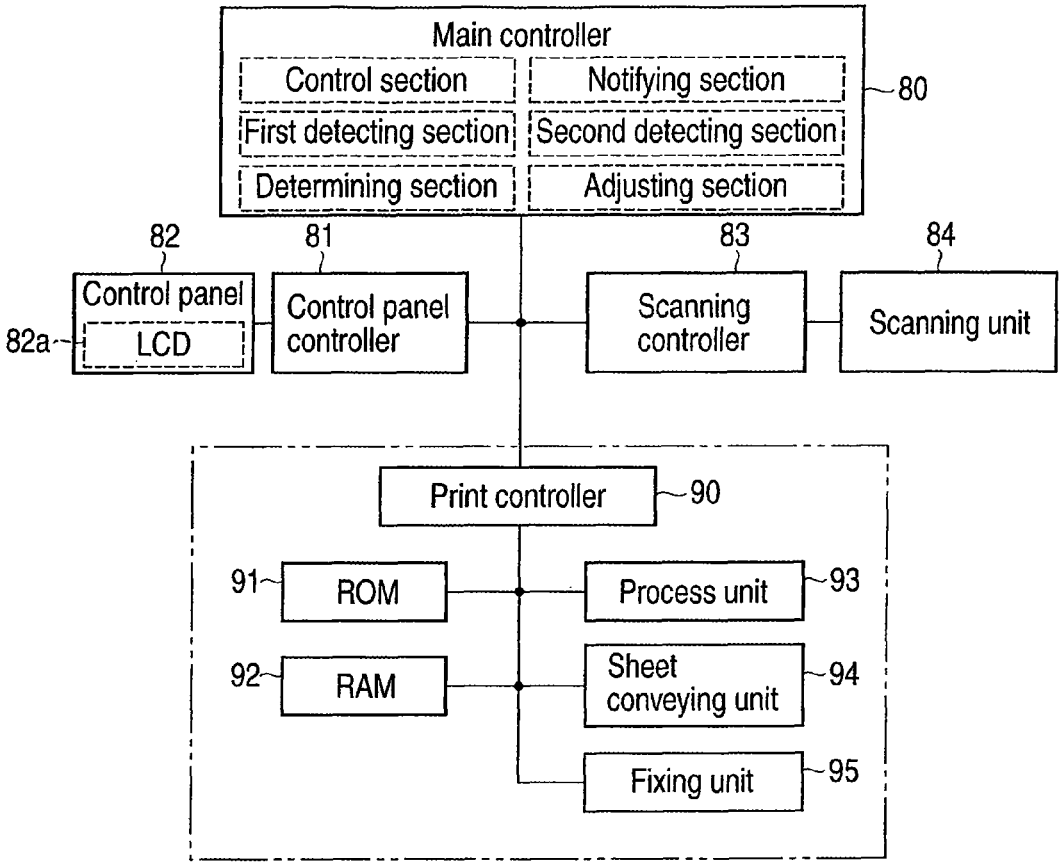
FIG. 3 is a block diagram showing a control circuit according to the embodiment.

A control circuit of a main body 1 is shown in FIG. 3.

A control panel controller 81, a scanning controller 83, and a print controller 90 are connected to a main controller 80. The control panel controller 81 controls a control panel 82 for setting operation conditions. The control panel 82 has an LCD 82*a* as a display unit. The scanning controller 83 controls a scanning unit 84. The scanning unit 84 includes the original glass 2, the cover 3, the carriage 4, the exposure lamp 5, the reflection mirrors 6, 7, and 8, the magnification lens block 9, and the CCD 10. The scanning unit 84 scans an image of an original set on the original glass 2 through optical main scanning and sub-scanning.

A ROM 91 for storing a control program and a test pattern image described later, a RAM 92 for storing data, a process unit 93, a sheet conveying unit 94, and a fixing unit 95 are connected to the print controller 90.

The process unit 93 includes the exposing unit 11, the photoconductive drums 21, 22, 23, and 24, the configuration of the peripheries of the photoconductive drums shown in FIG. 2, the transfer belt 25, the drive roller 26, the guide rollers 27, 28, and 29, the driven roller 30, the primary transfer rollers 41, 42, 43, and 44, the secondary transfer roller 57, and the hooks 71, 72, 73, and 74. The process unit 93 exposes the photoconductive drums 21, 22, 23, and 24 through main scanning and sub-scanning by laser beams to thereby print a scanned image of the scanning unit 84 on the paper sheet P.

The sheet conveying unit 94 includes the conveying path 53 and the configuration of the periphery thereof. The fixing unit 95 includes the heat roller 59 and the press-contact roller 60 and fixes the image printed on the paper sheet P by the process unit 93 on the paper sheet P.

Figure 4:
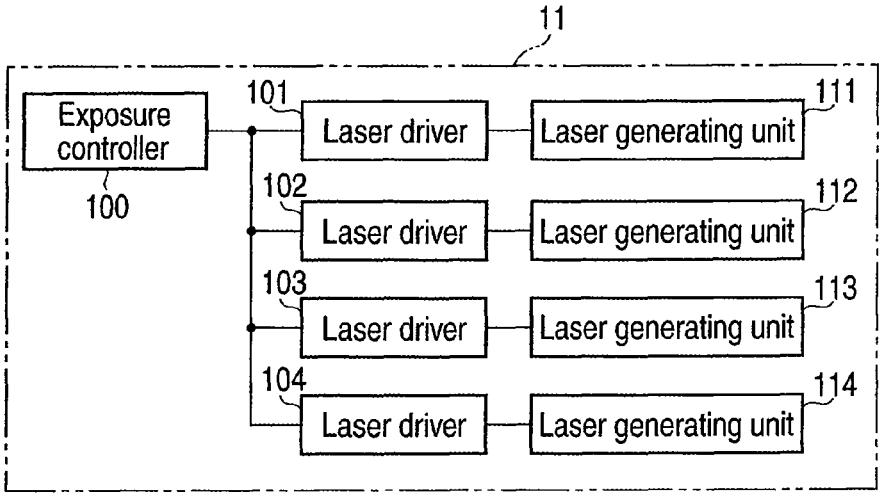
FIG. 4 is a block diagram showing an exposing unit shown in FIG. 1.

A configuration of the exposing unit 11 in the process unit 93 is shown in FIG. 4. The exposing unit 11 includes an exposure controller 100, laser drivers 101, 102, 103, and 104, and laser generating units 111, 112, 113, and 114. The exposing unit 11 exposes the surfaces of the photoconductive drums 21, 22, 23, and 24 through main scanning and sub-scanning by laser beams emitted from the laser generating units 111, 112, 113, and 114 to thereby form electrostatic latent images corresponding to the scanned image of the scanning unit 84 on the photoconductive drums 21, 22, 23, and 24.

The main controller 80 includes sections described in (1) to (6) below as main functions concerning density adjustment for printing.

(1) A control section that prints, when a density adjustment mode is set on the control panel 82, the test pattern image stored in the ROM 91 on the paper sheet P using the process unit 93.

(2) A first detecting section that detects, when the density adjustment mode is set and the printed test pattern image is scanned by the scanning unit 84, the density of the scanned test pattern image.

(3) A second detecting section that detects a difference between the detected density of the first detecting section and absolute density set in advance. The absolute density is intrinsic appropriate density and is set by the operation of the control panel 82.

(4) A determining section that determines a density correction amount for the printing by the process unit 93 according to the density difference detected by the second detecting section.

(5) An adjusting section that adjusts an exposure amount of the process unit 93 according to the density correction amount determined by the determining section.

(6) A notifying section that notifies, when the density difference detected by the second detecting section is abnormal, that the density difference is abnormal using display on the LCD 82*a* of the control panel 82.

Figure 5:
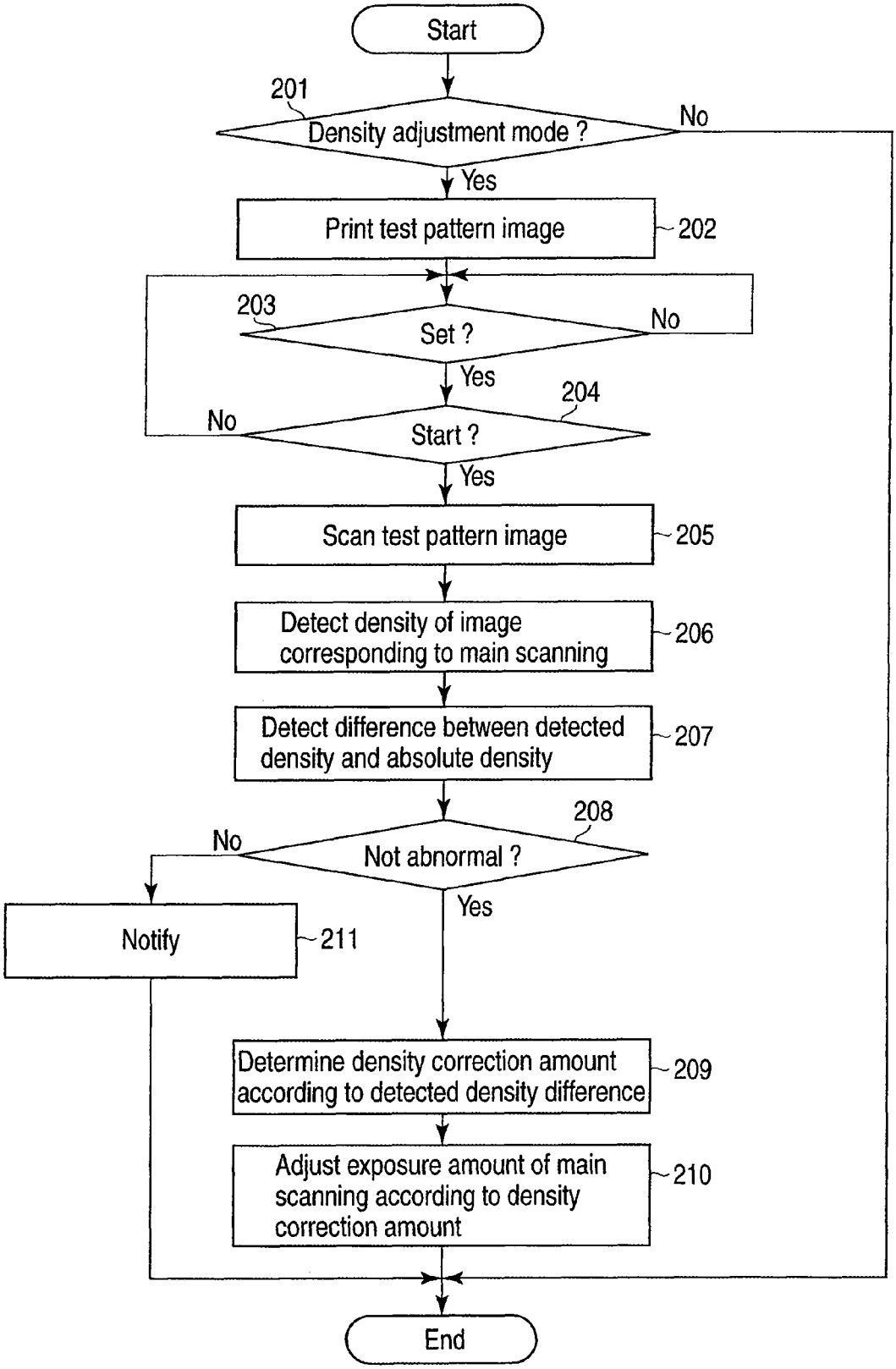
FIG. 5 is a flowchart for explaining actions in the embodiment.

Actions are explained with reference to a flowchart shown in FIG. 5.

Figure 6:
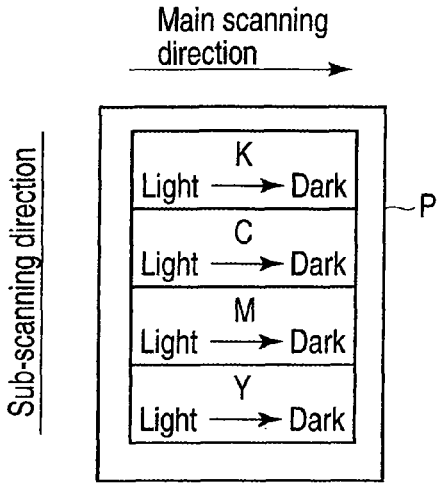
FIG. 6 is a diagram showing a sheet on which a test pattern image according to the embodiment is printed.

When the density adjustment mode is set on the control panel 82 (Act 201), the main controller 80 prints the test pattern image stored in the ROM 91 on the paper sheet P using the process unit 93 (Act 202). An example of the test pattern image printed on the paper sheet P is shown in FIG. 6.

In the test pattern image, a black pattern image K, a cyan pattern image C, a magenta pattern image M, and a yellow pattern image Y are arrayed in order along a sub-scanning direction of the exposing unit 11 in the process unit 93 (a longitudinal direction of the paper sheet P). The black pattern image K, the cyan pattern image C, the magenta pattern image M, and the yellow pattern image Y change from a low density (light) state to a high density (dark) state along a main scanning direction of the exposing unit 11 in the process unit 93 (a latitudinal direction of the paper sheet P).

When the paper sheet P on which the test pattern image is printed by the process unit 93 is set on the original glass 2 (YES in Act 203) and a start key of the control panel 82 is turned on (YES in Act 204), the main controller 80 scans the test pattern image of the paper sheet P on the original glass 2 using the scanning unit 84 (Act 205).

Figure 8:
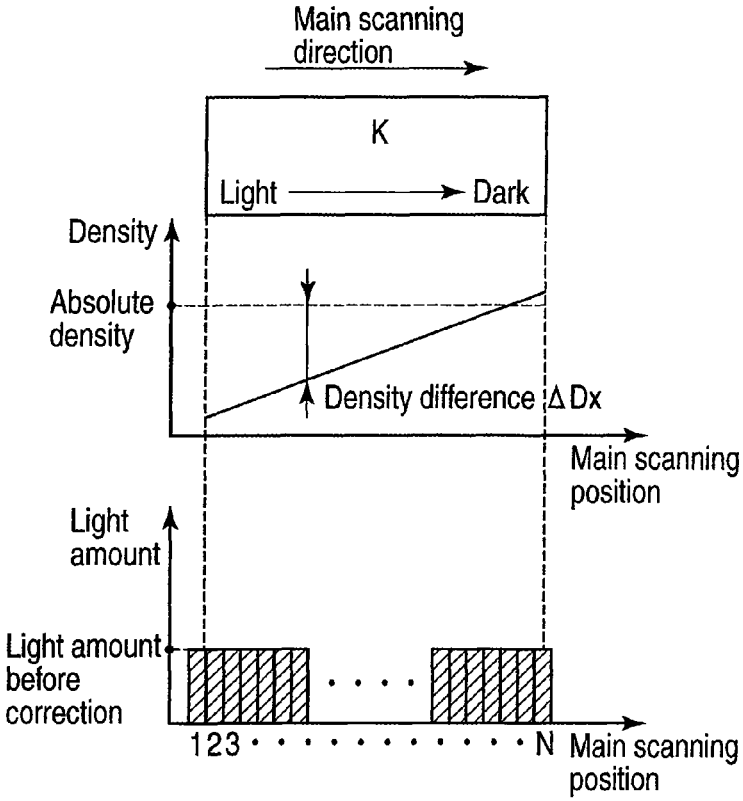
FIG. 8 is a diagram showing correspondence between a density change in a black image shown in FIG. 7 and an exposure amount in the scanning of the sheet shown in FIG. 6.
Figure 7:
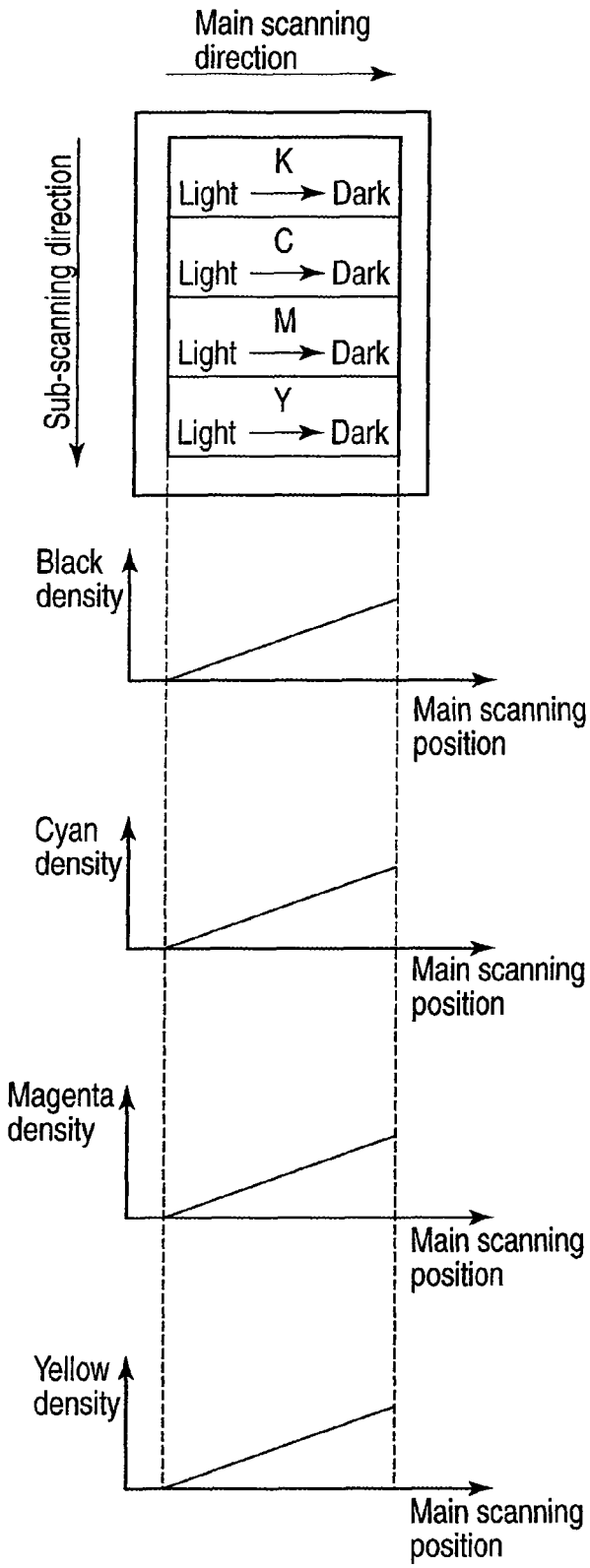
FIG. 7 is a diagram showing the test pattern image scanned from the sheet shown in FIG. 6 and the density by color of the scanned test pattern image.

The main controller 80 detects the density by color of an image corresponding to main scanning of the exposing unit 11 in the process unit 93 in the scanned test pattern image as shown in FIG. 7 (Act 206). As shown in FIG. 8, the main controller 80 detects a difference $\Delta Dx$ between the detected density and the absolute density set in advance (Act 207). Only density difference detection for a black image is shown in FIG. 8. However, the density difference detection is executed in the same manner for a cyan image, a magenta image, and a yellow image.

Figure 9:
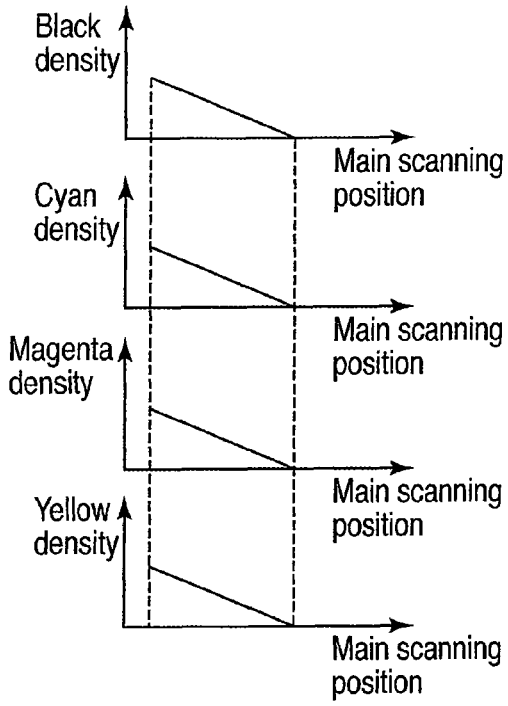
FIG. 9 is a diagram showing a density correction amount by color determined when the sheet shown in FIG. 6 is scanned.
Figure 10:
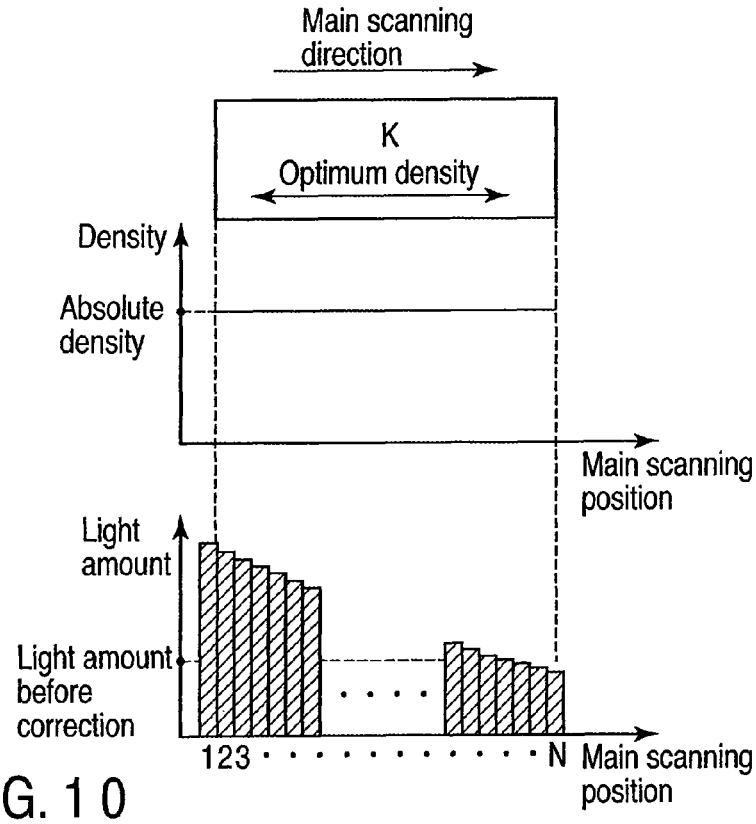
FIG. 10 is a diagram showing correspondence between an exposure amount adjusted on the basis of the density correction amount shown in FIG. 9 and a density change in a black image actually printed.
Figure 11:
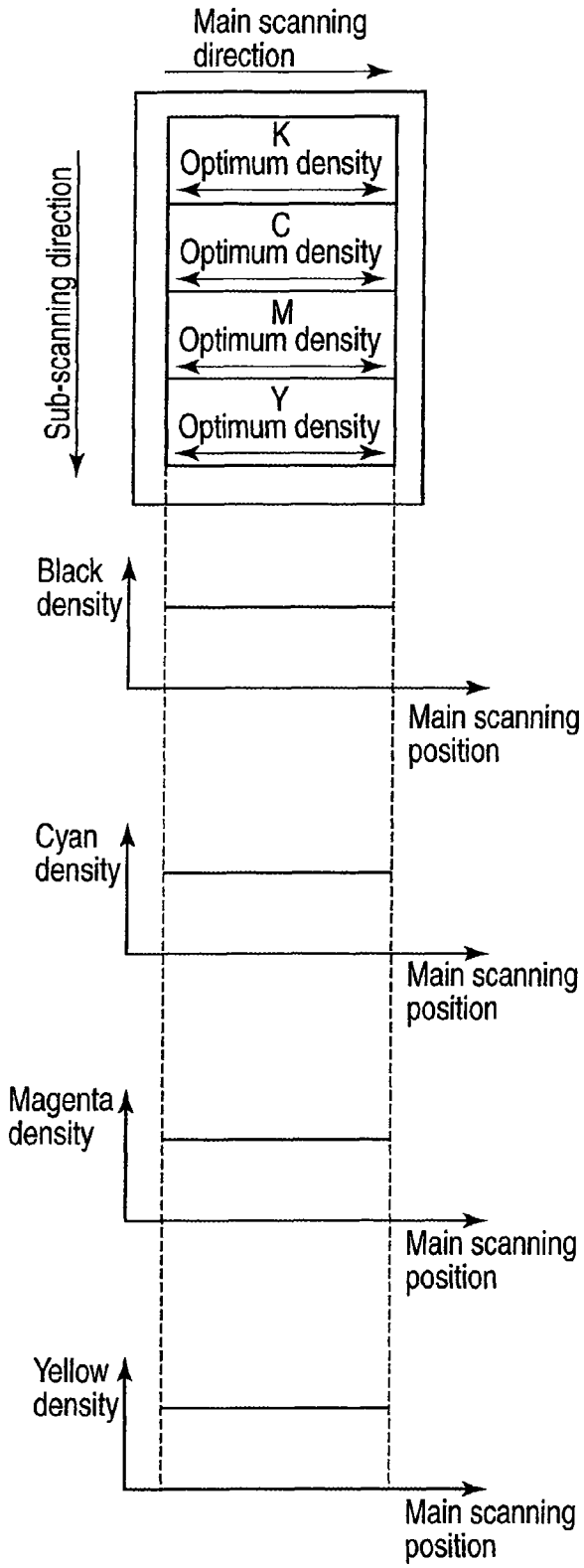
FIG. 11 is a diagram showing a test pattern image printed in the embodiment and the density by color of the test pattern image.

When the detected density difference ΔDx is equal to or smaller than a tolerance set in advance, the main controller 80 determines that the density difference ΔDx is not abnormal (YES in Act 208). In this case, as shown in FIG. 9, the main controller 80 determines a density correction amount for the printing by the process unit 93 according to the detected density difference ΔDx (Act 209). As shown in FIG. 10, the main controller 80 adjusts an exposure amount of the exposing unit 11 in the process unit 93, i.e., intensities of laser beams of the respective colors (Act 210). Only adjustment for the black image is shown in FIG. 10. However, the adjustment is executed in the same manner for the cyan image, the magenta image, and the yellow image.

The density of an image printed on the paper sheet P can be surely maintained at intrinsic appropriate density, i.e., so-called absolute density by the adjustment.

When the detected density difference ΔDx exceeds the tolerance, the main controller 80 determines that the density difference ΔDx is abnormal (NO in Act 208). In this case, the main controller 80 notifies that the density difference ΔDx is abnormal using the display on the LCD 82*a* of the control panel 82 (Act 211).

In the explanation in the embodiment, the density adjustment mode is set on the control panel 82. However, the density adjustment mode may be automatically set periodically.

In the explanation in the embodiment, each of the scanning of the test pattern image and the density detection is performed once. However, it is also possible that the scanning of the test pattern image and the density detection are repeated plural times, an average of densities detected by the density detection is calculated, and a difference ΔDx between the average and the absolute density set in advance is detected.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a scanning unit which optically scans an image of an original;

a process unit which includes image bearing members and exposes the image bearing members according to the image scanned by the scanning unit to thereby print the scanned image on a paper sheet;

a storing unit having stored therein a test pattern image;

a control section which controls the process unit to print the test pattern image stored in the storing unit on the paper sheet;

a detecting section which detects, when the printed test pattern image is scanned by the scanning unit, a difference between density of the scanned test pattern image and absolute density set in advance; and an adjusting section which adjusts an exposure amount of the process unit according to the density difference detected by the detecting section.

2. The apparatus according to claim 1, further comprising a notifying section which notifies, when the density difference detected by the detecting section is abnormal, that the density difference is abnormal.

3. The apparatus according to claim 1, wherein the process unit exposes the image bearing members through optical main scanning and sub-scanning corresponding to the scanned image of the scanning unit to thereby print the scanned image on the paper sheet, density of the test pattern image changes in a direction corresponding to the main scanning of the process unit, and the detecting section detects a difference between density of an image corresponding to the main scanning of the process unit in the scanned test pattern image and absolute density set in advance.

4. The apparatus according to claim 1, wherein the image bearing members are at least one photoconductive drum and a transfer belt which rotates while coming into contact with a surface of the photoconductive drum.

5. The apparatus according to claim 4, wherein the process unit includes:

a charging unit which charges the surface of the photoconductive drum;

an exposing unit which exposes the surface of the photoconductive drum charged by the charging unit through optical main scanning and sub-scanning to thereby form a latent image corresponding to the scanned image of the scanning unit on the photoconductive drum;

a developing unit which develops the latent image formed on the surface of the photoconductive drum;

a primary transfer roller which transfers an image on the photoconductive drum developed by the developing unit onto the transfer belt; and a secondary transfer roller which transfers the image, which is transferred onto the transfer belt by the primary transfer roller, onto a paper sheet.

6. The apparatus according to claim 5, wherein the primary transfer roller transfers the image on the photoconductive drum developed by the developing unit onto the transfer belt by rotating while pressing the transfer belt against and bringing the same into contact with the surface of the photoconductive drum.

7. The apparatus according to claim 1, wherein the image bearing members are plural photoconductive drums and a transfer belt which rotates while coming into contact with surfaces of the photoconductive drums.

8. The apparatus according to claim 7, wherein the process unit includes:

plural charging units that charge the surfaces of the photoconductive drums;

an exposing unit which exposes the surfaces of the photoconductive drums charged by the charging units through optical main scanning and sub-scanning to thereby form latent images corresponding to the scanned image of the scanning unit on the photoconductive drums;

plural developing units which develop the latent images formed on the surfaces of the photoconductive drums;

plural primary transfer rollers which transfer images on the photoconductive drums developed by the developing units onto the transfer belt; and a secondary transfer roller which transfers the images, which are transferred onto the transfer belt by the primary transfer rollers, onto a paper sheet.

9. The apparatus according to claim 8, wherein the photoconductive drums are a photoconductive drum for black, a photoconductive drum for cyan, a photoconductive drum for magenta, and a photoconductive drum for yellow, the developing units are a developing unit for yellow which develops in yellow a latent image formed on a surface of the photoconductive drum for yellow, a developing unit for cyan which develops in cyan a latent image formed on a surface of the photoconductive drum for cyan, a developing unit for magenta which develops in magenta a latent image formed on a surface of the photoconductive drum for magenta, and a developing unit for black which develops in black a latent image formed on a surface of the photoconductive drum for black, and the primary transfer rollers transfer the images on the photoconductive drums developed by the developing units onto the transfer belt by rotating while pressing the transfer belt against and bringing the same into contact with the surfaces of the photoconductive drums.

10. An image forming apparatus comprising:

a scanning unit which optically scans an image of an original;

a process unit which includes image bearing members and exposes the image bearing members according to the image scanned by the scanning unit to thereby print the scanned image on a paper sheet;

a storing unit having stored therein a test pattern image;

a control section which controls, when a density adjustment mode is set, the process unit to print the test pattern image stored in the storing unit on the paper sheet;

a first detecting section which detects, when the density adjustment mode is set and the printed test pattern image is scanned by the scanning unit, density of the scanned test pattern image;

a second detecting section which detects a difference between the detected density of the first detecting section and absolute density set in advance;

a determining section which determines a density correction amount for printing by the process unit according to the density difference detected by the second detecting section; and an adjusting section which adjusts an exposure amount of the process unit according to the density correction amount determined by the determining section.

11. The apparatus according to claim 10, further comprising a notifying section which notifies, when the density difference detected by the detecting section is abnormal, that the density difference is abnormal.

12. The apparatus according to claim 10, wherein the process unit exposes the image bearing members through optical main scanning and sub-scanning to thereby print the scanned image of the scanning unit on the paper sheet, density of the test pattern image changes in a direction corresponding to the main scanning of the process unit, and the detecting section detects a difference between density of an image corresponding to the main scanning of the process unit in the scanned test pattern image and absolute density set in advance.

13. The apparatus according to claim 10, wherein the image bearing members are at least one photoconductive drum and a transfer belt which rotates while coming into contact with a surface of the photoconductive drum.

14. The apparatus according to claim 13, wherein the process unit includes:

a charging unit which charges the surface of the photoconductive drum;

an exposing unit which exposes the surface of the photoconductive drum charged by the charging unit through optical main scanning and sub-scanning to thereby form a latent image corresponding to the image scanned by the scanning unit on the photoconductive drum;

a developing unit which develops the latent image formed on the surface of the photoconductive drum;

a primary transfer roller which transfers an image on the photoconductive drum developed by the developing unit onto the transfer belt; and a secondary transfer roller which transfers the image, which is transferred onto the transfer belt by the primary transfer roller, onto a paper sheet.

15. The apparatus according to claim 14, wherein the primary transfer roller transfers the image on the photoconductive drum developed by the developing unit onto the transfer belt by rotating while pressing the transfer belt against and bringing the same into contact with the surface of the photoconductive drum.

16. The apparatus according to claim 10, wherein the image bearing members are plural photoconductive drums and a transfer belt which rotates while coming into contact with surfaces of the photoconductive drums.

17. The apparatus according to claim 16, wherein the process unit includes:

plural charging units which charge the surfaces of the photoconductive drums;

an exposing unit which exposes the surfaces of the photoconductive drums charged by the charging units through optical main scanning and sub-scanning to thereby form latent images corresponding to the image scanned by the scanning unit on the photoconductive drums;

plural developing units which develop the latent images formed on the surfaces of the photoconductive drums;

plural primary transfer rollers which transfer images on the photoconductive drums developed by the developing units onto the transfer belt; and a secondary transfer roller which transfers the images, which are transferred onto the transfer belt by the primary transfer rollers, onto a paper sheet.

18. The apparatus according to claim 17, wherein the photoconductive drums are a photoconductive drum for black, a photoconductive drum for cyan, a photoconductive drum for magenta, and a photoconductive drum for yellow, the developing units are a developing unit for yellow which develops in yellow a latent image formed on a surface of the photoconductive drum for yellow, a developing unit for cyan which develops in cyan a latent image formed on a surface of the photoconductive drum for cyan, a developing unit for magenta which develops in magenta a latent image formed on a surface of the photoconductive drum for magenta, and a developing unit for black which develops in black a latent image formed on a surface of the photoconductive drum for black, and the primary transfer rollers transfer the images on the photoconductive drums developed by the developing units onto the transfer belt by rotating while pressing the transfer belt against and bringing the same into contact with the surfaces of the photoconductive drums.

19. A control method of an image forming apparatus including a scanning unit which optically scans an image of an original, a process unit which includes image bearing members and exposes the image bearing members according to the image scanned by the scanning unit to thereby print the scanned image on a paper sheet, and a storing unit having stored therein a test pattern image, the control method comprising:

printing the test pattern image stored in the storing unit on the paper sheet using the process unit;

detecting, when the printed test pattern image is scanned by the scanning unit, a difference between density of the scanned test pattern image and absolute density set in advance; and adjusting an exposure amount of the process unit according to the detected density difference.

* * * * *